United States Patent [19]

Baron et al.

[11] Patent Number: 4,934,642

[45] Date of Patent: Jun. 19, 1990

[54] SHELF-SUPPORT BRACKET

[75] Inventors: Peter Baron; Brian Levy, both of New South Wales, Australia

[73] Assignee: Australian Slatwall Industries Pty Ltd., Waterloo, Australia

[21] Appl. No.: 329,929

[22] Filed: Mar. 29, 1989

[51] Int. Cl.[5] ..... A47G 29/02

[52] U.S. Cl. ..... 248/250; 108/108; 211/90; 248/243

[58] Field of Search ..... 248/243, 250, 241, 242, 248/235; 108/108, 152; 211/90, 134

[56] References Cited

U.S. PATENT DOCUMENTS

| | | | |
|---|---|---|---|
| 4,429,850 | 2/1984 | Weber | 108/108 X |
| 4,450,970 | 5/1984 | Shepherd | 211/90 X |
| 4,508,301 | 4/1985 | Nicholson | 211/90 X |
| 4,691,887 | 9/1987 | Bessinger | 211/90 X |
| 4,709,892 | 12/1987 | Gurgui | 248/250 |
| 4,733,843 | 3/1988 | Bessinger | 211/90 X |
| 4,738,426 | 4/1988 | Bessinger | 248/250 |
| 4,765,575 | 8/1988 | Bergl | 108/152 X |
| 4,805,863 | 2/1989 | Armstrong | 108/108 X |
| 4,817,538 | 4/1989 | Michaelsen | 108/108 |

*Primary Examiner*—J. Franklin Foss
*Attorney, Agent, or Firm*—Ladas & Parry

[57] ABSTRACT

A support bracket comprises a substantially vertical wall, an upper horizontal wall extending substantially transversely to the vertical wall, the upper horizontal wall having a lower surface, and a lower horizontal wall substantially parallel to the upper horizontal wall, the lower horizontal wall having an upper surface. The upper and lower horizontal walls define a space which, in use, receives a shelf to be supported by the upper and lower walls in cantilever fashion. Track means are provided in the lower surface of the upper horizontal wall and the upper surface of the lower horizontal wall. Adjuster insert means are used in cooperation with the track means, the adjuster insert means having a tracking portion which registers with the track means to securely hold the adjuster insert means relative to the upper and lower horizontal walls respectively. The track means comprise a recess with a projection therein dividing the recess into two channeled grooves. The adjuster insert means is rectangular in cross-section, and has a slot along two edges thereof, the slot receiving the projection in the track means.

13 Claims, 8 Drawing Sheets

SHELF-SUPPORT BRACKET

BACKGROUND OF THE INVENTION

This invention relates to shelf-support brackets, and particularly such brackets which are attachable to display fixtures.

Shelf support brackets are typically used in retail or other merchandise outlet stores, and releasably attached to a display fixture on a wall. The support bracket may include a lip which is receivable within a channel on the display fixture. With the shelf support bracket firmly attached to the display fixture, a shelf is inserted in the shelf support bracket, so as to provide a cantilever shelf support. Various articles of merchandise may thereafter be placed on the shelf support for simple and attractive display.

Typically, the shelf-support bracket would incorporate substantially parallel top and lower surfaces which define a space in which the shelf is received. Each support bracket would have top and lower surfaces which are a fixed distance apart, and which are specifically adapted for receiving a shelf of specific thickness.

SUMMARY OF THE INVENTION

According to one aspect of the invention, there is provided a support bracket comprising a substantially vertical wall; an upper horizontal wall extending substantially transversely to the vertical wall, the upper horizontal wall having a lower surface; a lower horizontal wall substantially parallel to the upper horizontal wall, the lower horizontal wall having an upper surface, the upper and lower horizontal walls defining therebetween a space which, in use, receives a shelf which is support by the upper and lower horizontal walls respectively in cantilever fashion; track means in the lower surface of the upper horizontal wall and the upper surface of the lower horizontal wall; adjuster insert means for use in cooperation with the track means, the adjuster insert means having a tracking portion which registers with the track means to securely hold the adjuster insert means relative to the upper and lower horizontal walls respectively.

Preferably, the bracket comprises a suspension lip affixed to the vertical wall, the suspension lip, in use, attaching to a display fixture, and having a horizontal portion substantially continuous with the upper horizontal wall, and an upwardly projecting vertical flange.

Conveniently, the track means in the lower surface of the upper horizontal wall and the upper surface of the lower horizontal wall are located in the upper and lower horizontal wall respectively at a location thereon remote from the vertical wall. The track means may comprise a recess in the wall, the recess extending across the wall, the recess including a projection therein dividing the recess into two parallel channeled grooves. Preferably, the projection is eccentrically located in the recess thereby dividing the recess into a wide channel groove and a narrow channel groove.

The adjuster insert means may be an elongate body of substantially rectangular cross-section with a long side and a short side, the adjuster insert means having a slot along each of the long side and short side thereof, the slot being adapted, in use, to accommodate the projection in the recess, whereby the adjuster insert can be arranged in two positions with respect to the track means, the first position comprising the slot in the long side of the adjuster insert receiving the projection, the second position comprising the slot in the short side of the adjuster insert receiving the projection. Preferably, the adjuster insert means has one or more of its surfaces comprised of a series of ridges, the ridges on the surface of one insert adjuster means engaging spaces between the ridges on a second insert adjuster means wherein when two adjuster means are placed adjacent each other, the ridges engage preventing slippage or movement between the adjacent adjuster means.

Preferably, the vertical wall has a rear surface, and further track means are provided in the rear surface, the track means being adapted to receive adjuster insert means having a tracking portion which registers with the track means. The track means in the rear surface of the vertical wall are located at or near a lower end of the vertical wall.

According to another aspect of the invention, there is provided a method of supporting a cantilever shelf with a bracket, the method comprising providing a shelf support bracket having a vertical wall, an upper horizontal wall and a lower horizontal wall defining a space therebetween for accommodating a shelf; providing tracking means in a lower surface of the upper horizontal wall and an upper surface of the lower horizontal wall; inserting an adjuster insert means in one or more of the track means to reduce the size of the space defined between the upper and lower horizontal walls so that shelves of varying thicknesses can be accommodated therein according to the mode of use of such adjuster insert means and the number thereof used.

DETAILED DESCRIPTION OF THE PREFERRED EMBODIMENTS

Figure 1:
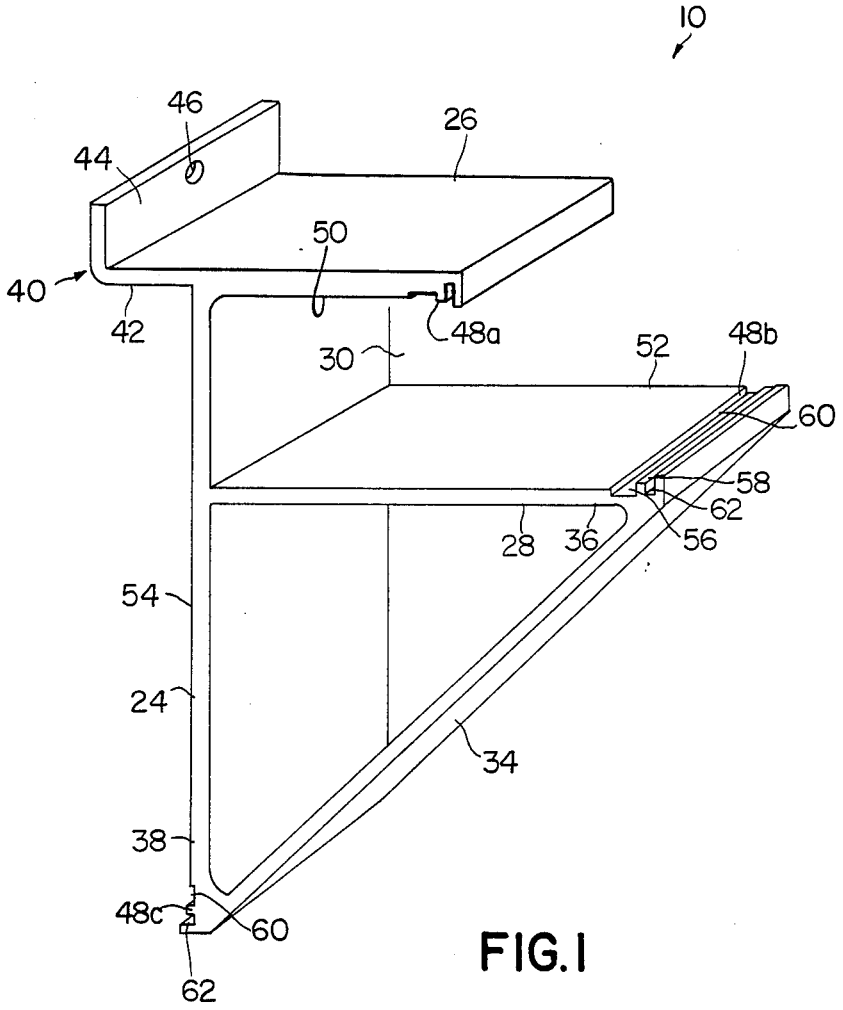
FIG. 1 is a perspective view of a shelf support bracket of the invention.
Figure 2:
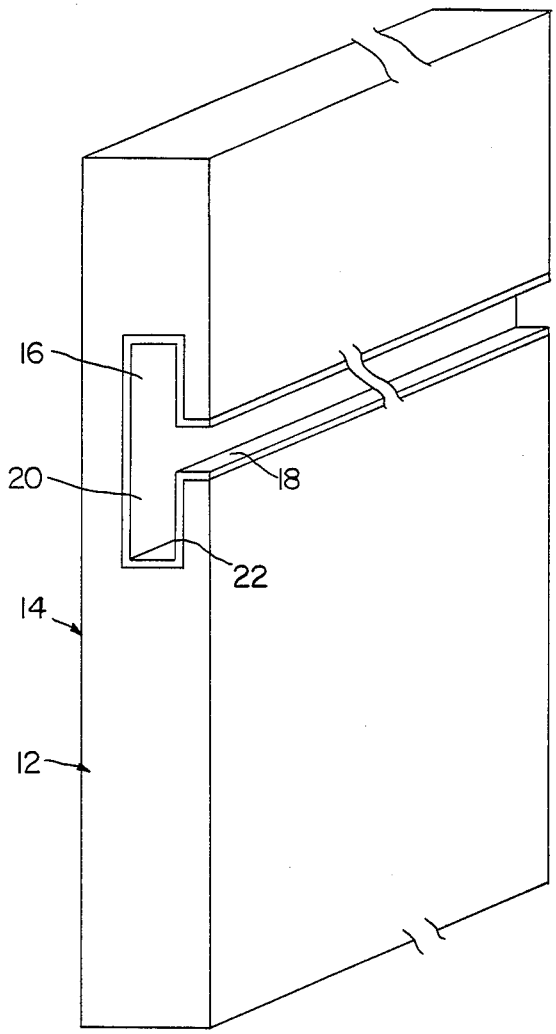
FIG. 2 is a perspective view of a display fixture for use with the bracket.
Figure 3:
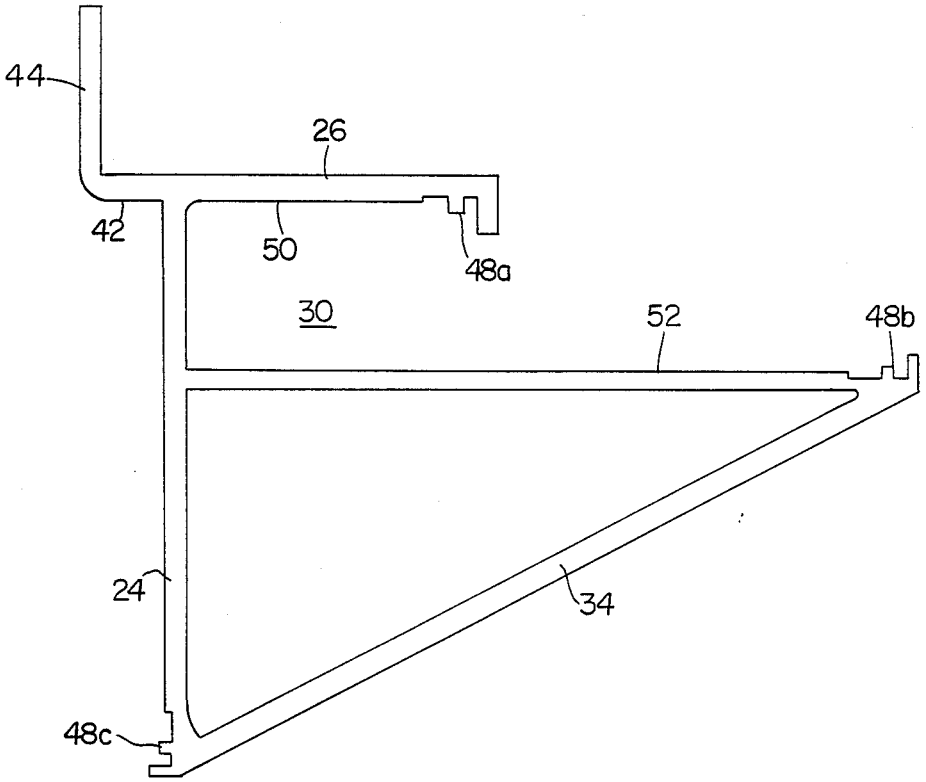
FIG. 3 is a side view of the shelf support bracket shown in FIG. 1.
Figure 4:
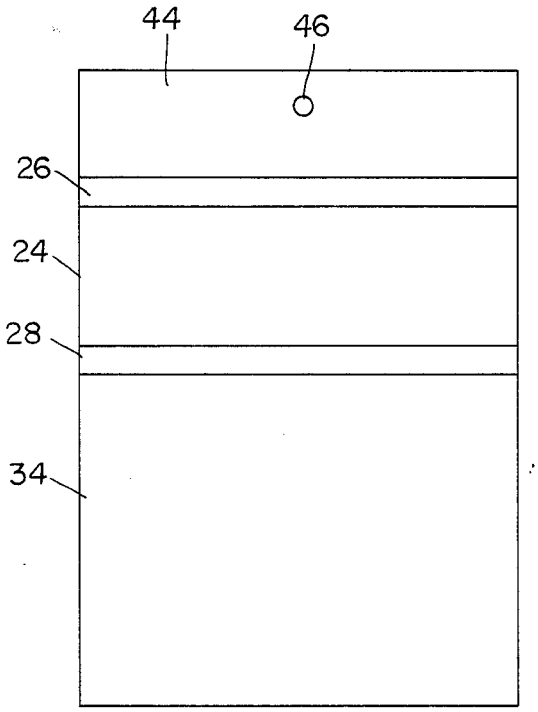
FIG. 4 is a front view of the shelf support bracket shown in FIG. 1.
Figure 5:
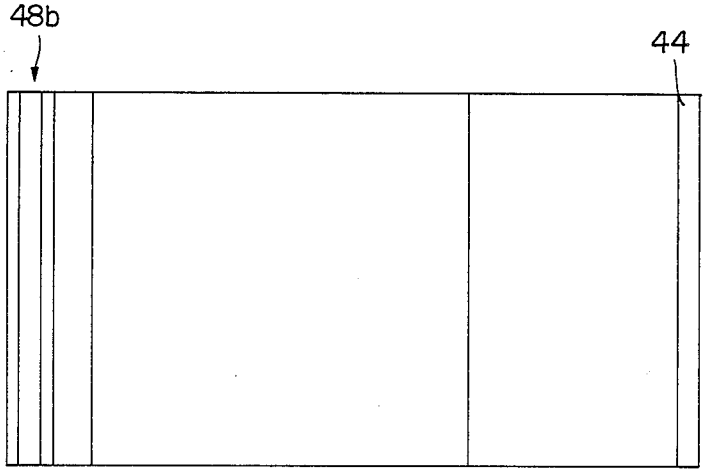
FIG. 5 is a top view of the shelf support bracket shown in FIG. 1.
Figure 6:
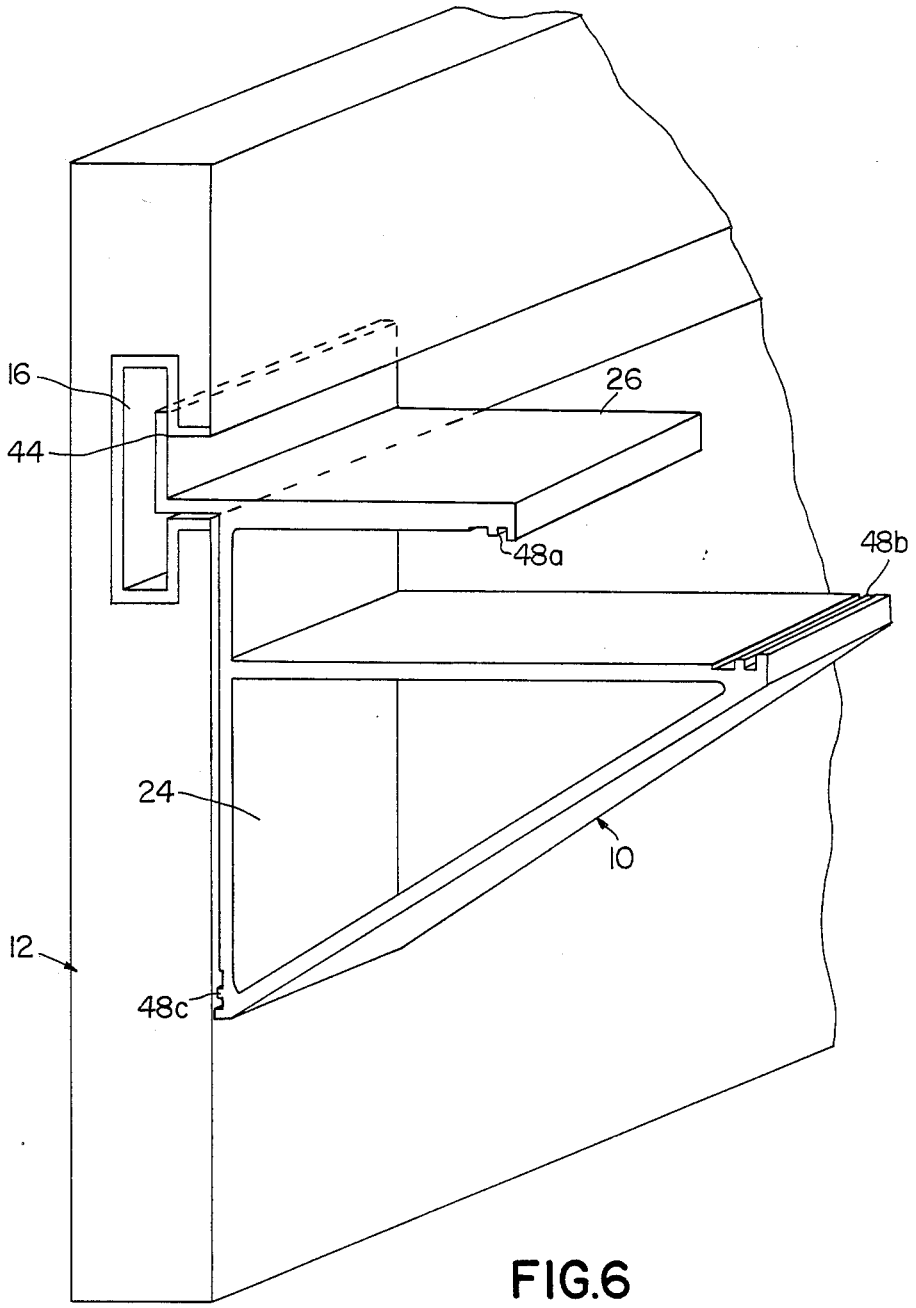
FIG. 6 is a perspective view of a bracket attached to a display fixture.

With reference to the drawings, there is shown a preferred embodiment of the invention, comprising a shelf support bracket 10 which may be fixed to a display fixture 12, the display fixture 12 typically being attached to or forming a wall 14 and having a series of horizontal channels 16 spaced thereover. In the present embodiment, each horizontal channel comprises a mouth portion or slot 18 leading into a rectangular chamber portion 20. The channel 16 is preferably lined with a plastic or aluminum extruded insert 22 to prevent wear of those portions of the display fixture 12 which border the horizontal channels 16.

The shelf support bracket 10 comprises a rear vertical wall 24, an upper horizontal wall 26, and a lower horizontal wall 28. The upper horizontal wall 26 is located at the top of the rear vertical wall 24, while the lower horizontal wall 28 extends outwardly from the rear vertical wall 24 approximately one third of the way down its length. The upper and lower horizontal walls 26 and 28 define therebetween a rectangular space 30 which is adapted to receive a shelf 32, to be described in greater detail hereunder.

A support wall 34 extends between the outer end 36 of the lower horizontal wall 28 and the lower end 38 of the rear vertical wall 24. In this way, additional support is provided to the lower horizontal wall, which is thus well adapted to support in cantilever fashion a shelf 32, as well as any merchandise or articles which may be placed thereon.

A suspension lip 40 is also provided at the upper end of the vertical wall 24. The lip 40 comprises a horizontal portion 42 and a vertical flange 44. In use, the vertical flange is adapted to pass through the mouth portion or slot 18 of the horizontal channel 16 for location in the rectangular chamber portion 20. The horizontal portion 42 extends, when the bracket is attached to the wall 14, through the mouth portion or slot 18. An aperture 46 is provided in the vertical flange 44, so that the bracket 10 may be more permanently affixed to the display fixture by driving a nail or screw through the aperture 46 between the bracket 10 and the display fixture 12.

Tracking grooves 48 are positioned on the shelf support bracket 10 at various locations. A tracking groove **48*a* is located on the undersurface 50 of the upper horizontal wall 26, tracking groove 48*b* is located on the upper surface 52 of the lower horizontal wall 28 and tracking groove 48*c* is located on the rear surface 54 of the vertical wall 24. Each tracking groove 48 comprises a recess 56 having a projection 58 therein. The projection 58 is not centrally located within the recess 56, and divides the recess 56 into a wide groove 60 and a narrow groove 62**.

It will be noted that the tracks 48 run across the entire 10 width of the bracket 10 at their respective locations.

The shelf support bracket 10 further comprises a shelf adjuster insert 64, an insert optionally being used with each set of tracks 48. The shelf adjuster insert 64 is substantially rectangular in cross section, and is constructed for use with a track 48.

Figure 7:
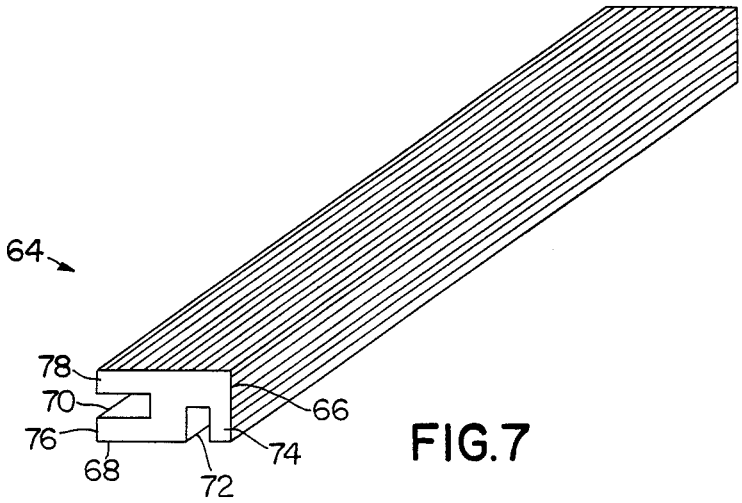
FIG. 7 is a perspective view of a shelf adjuster insert for use with shelf support bracket shown in FIG. 1.
Figure 8:
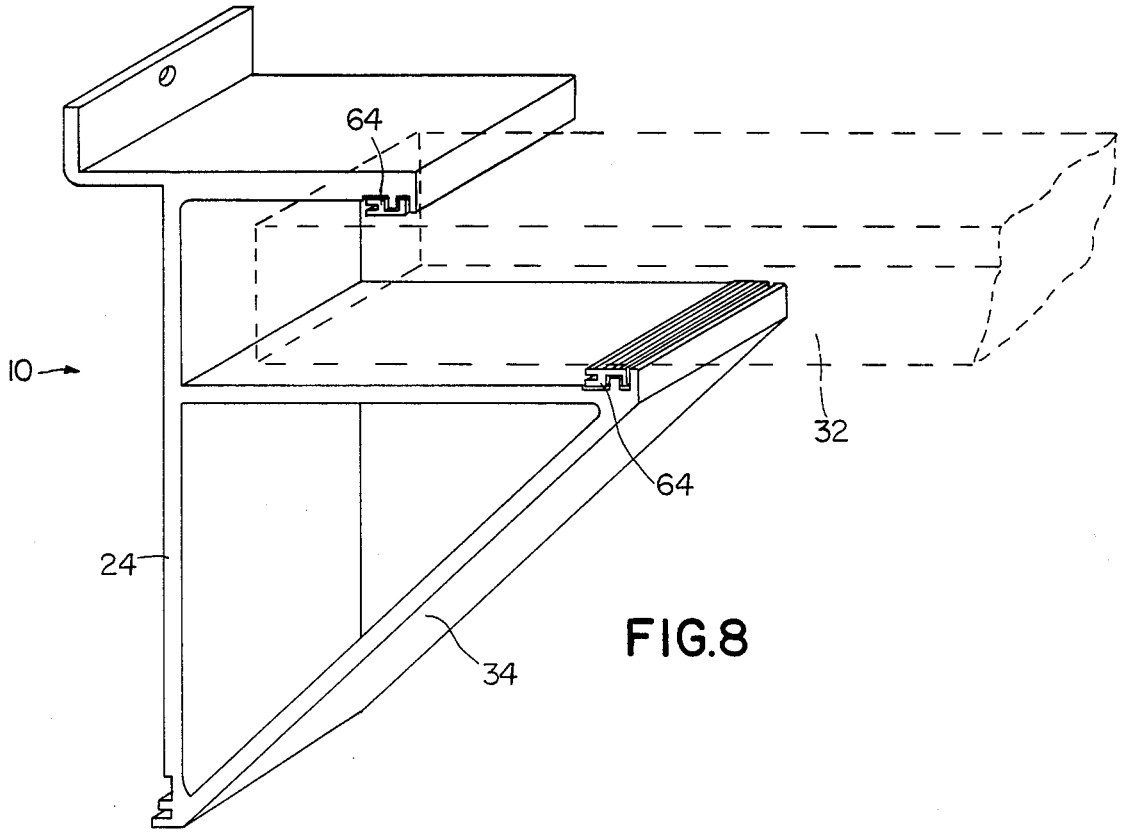
FIG. 8 is a perspective view of a bracket, shelf and adjuster inserts of the invention.
Figure 9:
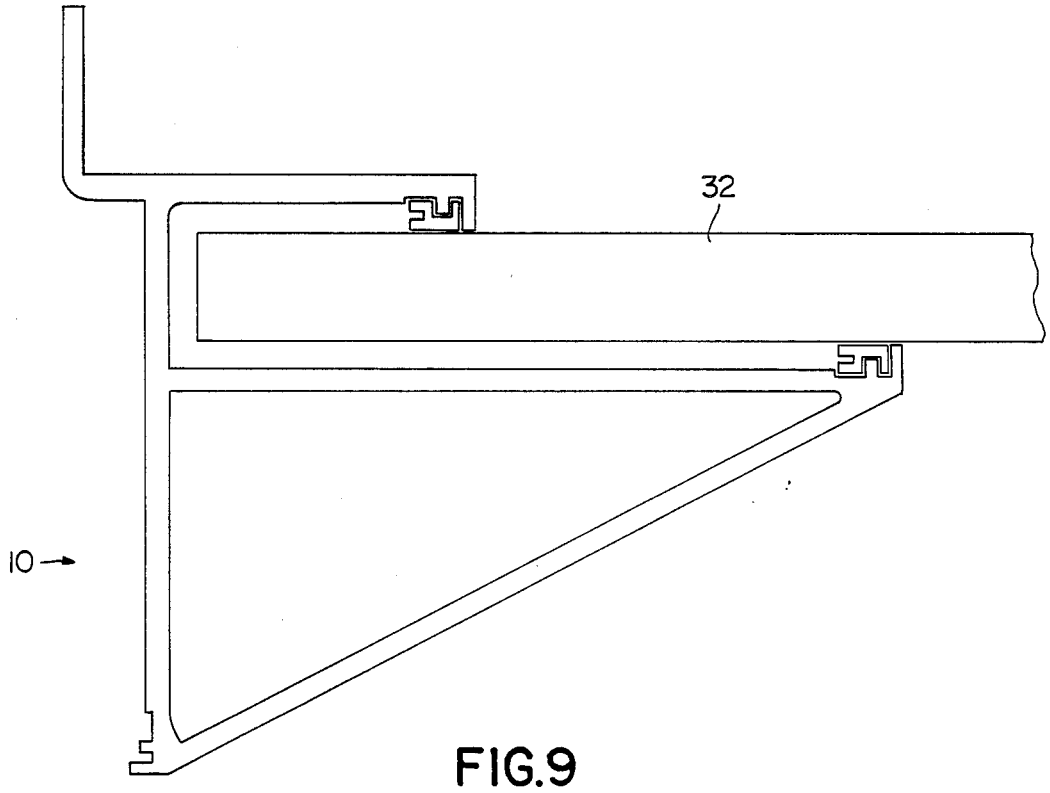
FIG. 9 is a side view of a bracket, shelf and adjuster means of the invention.

Each adjuster insert 64 has a short side 66 and a long side 68. A first slot 70 is fashioned in the adjuster insert so as to open along one short side 66 thereof, while a second slot 72 is fashioned in the long side 68 of the adjuster insert and is open at the long side 68. One or more sides of the adjuster insert 64 may be knurled, and in the presently shown embodiment in FIG. 7, two sides (a long side and a short side) have such a knurled configuration.

In use, a shelf adjuster insert 64 may be used with any one or more of the tracks **48*a*, 48*b*, and 48*c*. The adjuster insert 64 may be positioned with respect to each track 48 in two ways. In a first position, the adjuster insert 64 may be located in the track 48 such that the projection 58 extends into the second slot 72, with the arm 74 being located in the narrow groove 62 and a portion of the long side 68 being positioned in the wide groove 60. In a second position, the adjuster insert 64 may be positioned in any one of the tracks 48 whereby the projection 58 extends into the first slot 70, with the arms 76 and 78 straddling the projection 58**.

With respect to the tracks **48*a* and 48*b*, positioning of the adjuster insert 64 in the first or second positions will result in a narrowing of the space 30 by different amounts. Thus, the space 30 will be narrower when an adjuster insert 64 is located in the track 48*b* in the second position, than when the adjuster insert 64 is located in the track 48*b* in the first position. A similar situation would prevail with respect to location of an adjuster insert 64 in the track 48*a***.

Turning to the track **48*c*, at the lower end 38 of the rear vertical wall 24, positioning of an adjuster insert 64 therein in either the first or second position will have the effect of distancing the lower end 38 of the rear vertical wall from the display fixture 12 by different amounts. If no such adjuster insert 64 is positioned in the track 48*c*, the rear vertical wall 24 will typically lie adjacent the display fixture 12. Where the adjuster insert 64 is inserted in the track 48*c* in either the first or second position, the rear vertical wall will be moved away from the display fixture 12, and the effect will be that the entire bracket 10 will be slightly tilted with respect to the display fixture. It will be appreciated that tilting of the bracket 10 results in an adjustment of the angle of a shelf 32 in the space 30**.

The shelf support bracket 10, used in combination with one or more shelf adjuster inserts 64, is readily adaptable for use with shelves 32 of differing thicknesses, and appropriate use of the inserts 64 can result in the shelf 32 being mounted at different angles, which may be conveniently selected depending upon the merchandise or display items to be located on the shelf 32.

With respect to a particular shelf support bracket 10, the thickest shelf 32 can be accommodated in the space 30 with no shelf adjuster inserts in place. Using a single shelf adjuster insert, the space 30 can be progressively narrowed. Thus, there may be an absence of a shelf adjuster insert 64 in track **48*a*, but an adjuster insert 64 may be located in either the first or second position in the track 48*b*. Alternatively, an adjuster insert 64 may be located in track 48*a* in a first position, and an adjuster insert 64 in track 48*b* in either the first or second position. Finally, an adjuster insert 64 may be located in the second position in the track 48*a*, with a further adjuster insert 64 located in track 48*b* in either the first or second position. Using this technique alone, it will be noted that shelves of seven different thicknesses may be located in a single bracket in the space 30 according to the use and configuration of adjuster inserts 64 in either of the tracks 48*a* and 48*b*. The thickness defined by the space 30 may thus be adjusted to be bigger or smaller in small increments, and the expense of providing a different size bracket for a particular thickness shelf is obviated. Further, it will also be noted that the large number of thicknesses can be provided with only a single size and shape shelf adjuster insert 64**.

The fine adjustment of the angle and tilt of the shelf 32 may further be varied, as set forth above, by location of a shelf adjuster insert 64 in the track **48*c*. The use and effect of an insert within the track 48*c*** has already been described above.

It is also to be noted that the space 30 may be further narrowed in addition to the methods described above by placing a first shelf adjuster insert 64 in the track **48*b*, and placing a second adjuster insert on top of the first insert such that knurled surfaces of the adjuster insert are in contact with each other and thereby prevent slippage of the first insert with respect to the second insert. A similar arrangement can be used in the track 48*a*, although it will be appreciated that a second insert 64 requires the upward pressure of the shelf 32 to hold it against the first insert 64 located in the track 48***a*. However, since the shelf 32 would in any event have an upward force due to the cantilever arrangement thereof, more than one insert 64 may be used with respect to the track 48*a*. Also, each insert may be in either the first or second position.

Thus, using no, one, or two inserts with respect to any one or more of the tracks 48*a* and 48*b* can produce a very large number of space 30 adjustments whereby the space 30 can accommodate shelves 32 of varying thicknesses. The bracket is thus extremely versatile and has a wide application in that only a single bracket is necessary for shelves whose thickness may vary considerably. Since the shelf is supported in cantilever fashion in the space 30, there will be an upward force from the shelf at the track 48*a*, and a downward force by the shelf at the track 48*b*, and these forces will securely hold one or more shelf adjuster inserts in position over the tracks.

The invention is not limited to the precise construction or details hereinbefore described or illustrated. For example, tracks 48 need not be provided in both the undersurface 50 of the upper horizontal wall 26 and the upper surface 52 of the lower horizontal wall 28. Only one such track need be provided. Additionally, the track 48*c* may be omitted.

Any suitable shape shelf adjuster insert may be provided to meet the requirements for narrowing the space 30 above. Further, the tracks 48*a* and 48*b* may be located at different points along the undersurface 50 and upper surface 52 of the upper and lower horizontal walls 26 and 28 respectively.

We claim:

1. A support bracket comprising:

a support wall;

an upper wall extending substantially transversely to the support wall, the upper wall having a lower surface;

a lower wall fixed near an end thereof to the support wall and being substantially parallel to the upper wall, the lower wall having an upper surface, the upper and lower walls defining therebetween a space of fixed dimension which, in use, receives a shelf which is supported by the upper and lower walls respectively in cantilever fashion, track means in the lower surface of the upper wall and the upper surface of the lower wall;

adjuster insert means for use in cooperation with the track means, the adjuster insert means having a tracking portion which registers with the track means to securely hold the adjuster insert means relative to the upper and lower walls respectively, the adjuster insert means permitting shelves of differing thickness to be received in the space.

2. A bracket as claimed in claim 1 further comprising a suspension lip affixed to the support wall, the suspension lip, in use, attaching to a display fixture.

3. A bracket as claimed in claim 2 wherein the suspension lip comprises a portion substantially continuous with the upper wall, and a transverse projecting flange.

4. A bracket as claimed in claim 3 wherein the flange incorporates an aperture therein whereby the bracket may be affixed to the display fixture by means of a screw.

5. A bracket as claimed in claim 1 further comprising a reinforcing wall extending between an outer end of the lower wall and a lower end of the support wall to provide additional support to the lower wall.

6. A bracket as claimed in claim 1 wherein the track means in the lower surface of the upper wall and the upper surface of the lower wall are located in the upper and lower walls respectively at a location thereon remote from the support wall.

7. A bracket as claimed in claim 1 wherein the track means comprises a recess extending across the wall, the recess including a projection therein dividing the recess into two parallel channeled grooves.

8. A bracket as claimed in claim 7 wherein the projection is eccentrically located in the recess thereby dividing the recess into a wide channel groove and a narrow channel groove.

9. A bracket as claimed in claim 7 wherein the adjuster insert means is an elongate body of substantially rectangular cross-section with a long side and a short side, the adjuster insert means having a slot along each of the long side and short side thereof, the slot being adapted, in use, to accommodate the projection in the recess, whereby the adjuster insert can be arranged in two positions with respect to the track means, the first position comprising the slot in the long side of the adjuster insert receiving the projection, the second position comprising the slot in the short side of the adjuster insert receiving the projection.

10. A bracket as claimed in claim 1 wherein the adjuster insert means has one or more of its surfaces comprised of a series of ridges, the ridges on the surface of one insert adjuster means engaging spaces between the ridges on a second insert adjuster means wherein when two adjuster means are placed adjacent each other, the ridges engage preventing slippage or movement between the adjacent adjuster means.

11. A bracket as claimed in claim 1 wherein the support wall has a rear surface, and further track means are provided in the rear surface, the track means being adapted to receive adjuster insert means having a tracking portion which registers with the track means.

12. A bracket as claimed in claim 11 wherein the track means in the rear surface of the support wall is located at or near a lower end of the support wall.

13. A method of supporting a cantilever shelf with a bracket, the method comprising:

providing a shelf support bracket having a support wall, an upper wall and a lower wall both fixed to the support wall and immovable relative thereto, the upper and lower walls defining a space of fixed dimension therebetween for accommodating a shelf, providing tracking means in a lower surface of the upper wall and an upper surface of the lower wall;

inserting an adjuster insert means in one or more of the track means in the space defined between the upper and lower walls so that shelves of varying thicknesses can be accommodated therein according to the mode of use of such adjuster insert means and the number thereof used.

* * * * *